US009311871B2

(12) United States Patent
Kim

(10) Patent No.: US 9,311,871 B2
(45) Date of Patent: Apr. 12, 2016

(54) DEVICES AND METHODS FOR REDUCING POWER TO DRIVE PIXELS OF A DISPLAY

(71) Applicant: APPLE INC., Cupertino, CA (US)

(72) Inventor: Taesung Kim, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 394 days.

(21) Appl. No.: 13/677,037

(22) Filed: Nov. 14, 2012

(65) Prior Publication Data

US 2014/0085287 A1 Mar. 27, 2014

Related U.S. Application Data

(60) Provisional application No. 61/706,034, filed on Sep. 26, 2012.

(51) Int. Cl.
*G09G 5/00* (2006.01)
*G09G 3/36* (2006.01)

(52) U.S. Cl.
CPC ..... *G09G 3/3614* (2013.01); *G09G 3/3648* (2013.01); *G09G 2320/0673* (2013.01); *G09G 2330/028* (2013.01)

(58) Field of Classification Search
None
See application file for complete search history.

(56) References Cited

U.S. PATENT DOCUMENTS 6,704,066 B2 3/2004 Tsumura et al.
6,940,481 B2 9/2005 Konno et al.
7,006,059 B2 2/2006 Choi
7,663,590 B2 2/2010 Okazaki
7,986,376 B2 7/2011 Saito et al.
8,059,117 B2 11/2011 Takatori
2005/0184940 A1* 8/2005 Oh ..... G09G 3/3614 345/87
2007/0126944 A1* 6/2007 Kim et al. ..... 349/43
2009/0322660 A1* 12/2009 Chung et al. ..... 345/87
2010/0238134 A1* 9/2010 Day ..... G06F 3/0412 345/174
2010/0253668 A1* 10/2010 Sugihara et al. ..... 345/211
2012/0092319 A1* 4/2012 van Veenendaal ..... G09G 3/344 345/211
2013/0100122 A1* 4/2013 Moon et al. ..... 345/419

* cited by examiner

*Primary Examiner* — Adam R Giesy
*Assistant Examiner* — Henok Heyi
(74) *Attorney, Agent, or Firm* — Fletcher Yoder PC

(57) ABSTRACT

The present disclosure relates to various techniques, systems, devices, and methods for driving high resolution monitors while reducing artifacts thereon. Data may be stored on pixels of a display such that a first half of the pixels of the display (e.g., arranged in a checkerboard fashion) have data of a first polarity stored on them during a first half of a frame, then a second half of the pixels of the display have data of a second polarity stored on them during a second half of the frame. In such an arrangement, the polarity used to provide data to the pixels may be switched only one time during each frame. The data provided to drive the second half of pixels may be inverted relative to the first half of pixels. The display may use the dot inversion method to provide overall good image quality, yet operate with reduced power consumption.

25 Claims, 11 Drawing Sheets

98

| | FRAME INVERSION | LINE INVERSION | COLUMN INVERSION | DOT INVERSION | 1+2DOT INVERSION | Z-SHAPE INVERSION |
|---|---|---|---|---|---|---|
| POLARITY MAP | 100 ++++ ++++ ++++ ++++ ++++ 60<br>102 - - - - - - - - - - - - - - - - 60 | 100 ++++ - - - - ++++ - - - - ++++ 60<br>102 - - - - ++++ - - - - ++++ 60 | 100 - + - + - + - + - + - + - + - + 60<br>102 + - + - + - + - + - + - + - + - + 60 | 100 + - + - - + - + + - + - - + - + 60<br>102 - + - + + - + - - + - + + - + - 60 | 100 + - + - - + - + - + - + + - + - 60<br>102 - + - + + - + - + - + - - + - + 60 | 100 + + + + - + + + + + + + - + + + 60<br>102 + + + + + + + + + + + + + + + + 60 |
| POWER CONSUM-PTION | LOW | LOW | LOW | HIGH | HIGH | LOW |
| IMAGE QUALITY | POOR (FLICKER) | POOR (CROSSTALK, POWER NOISE) | POOR (VERTICAL CROSSTALK, VERTICAL LINE FLICKER) | GOOD | MEDIUM | MEDIUM (VERTICAL CROSSTALK, HORIZONTAL LINE ARTIFACT) |

FIG. 8

DEVICES AND METHODS FOR REDUCING POWER TO DRIVE PIXELS OF A DISPLAY

CROSS REFERENCE TO RELATED APPLICATIONS

This application is a Non-Provisional patent application of U.S. Provisional Patent Application No. 61/706,034, entitled "Devices and Methods for Reducing Power to Drive Pixels of a Display", filed Sep. 26, 2012, which are herein incorporated by reference.

BACKGROUND

The present disclosure relates generally to electronic displays and, more particularly, to reducing power to drive pixels of displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and handheld devices (e.g., cellular telephones, audio and video players, gaming systems, and so forth). Such LCD devices typically provide a flat display in a relatively thin package that is suitable for use in a variety of electronic goods. In addition, such LCD devices typically use less power than comparable display technologies, making them suitable for use in battery-powered devices or in other contexts where it is desirable to minimize power usage.

LCDs typically include an LCD panel having, among other things, a liquid crystal layer and various circuitry for controlling orientation of liquid crystals within the layer to modulate an amount of light passing through the LCD panel and thereby render images on the panel. If a voltage of a single polarity is consistently applied to the liquid crystal layer, a biasing (polarization) of the liquid crystal layer may occur such that the light transmission characteristics of the liquid crystal layer may be disadvantageously altered.

To aid in preventing this biasing of the liquid crystal layer, periodic inversion of the electric field applied to the liquid crystal layer may be utilized. Furthermore, various inversion techniques may be utilized to reduce visual artifacts caused by slight differences in the value of applied positive and negative voltages during the periodic inversion of the electric field applied to the liquid crystal layer. For example, a dot inversion method may cause each adjacent pixel location in the liquid crystal layer to be driven with a voltage opposite of its neighboring pixels over a given time frame. This technique may greatly reduce the generation of visual artifacts on the LCD, however, it may require a substantial amount of power to perform. Accordingly, there is a need for low power inversion techniques that minimize the generation of visual artifacts on an LCD.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to various techniques, systems, devices, and methods for driving high resolution monitors while reducing artifacts thereon. Accordingly, the rows of pixels of a display may be coupled to scanning lines so that every other pixel in a row is coupled to a first scanning line and the remaining pixels in the row are coupled to a second scanning line. Data may be stored on the pixels of the display such that a first half of the pixels of the display (e.g., arranged in a checkerboard fashion) have data of a first polarity stored on them during a first half of a frame, then a second half of the pixels of the display have data of a second polarity stored on them during a second half of the frame. In such an arrangement, the polarity used to provide data to the pixels may be switched only one time during each frame. The polarity switch may occur by changing a common voltage line (VCOM) of the display between zero volts and a maximum positive operating voltage. Furthermore, the data provided to drive the second half of pixels may be inverted relative to the first half of pixels. By switching polarity only once during each frame, a direct current (DC) voltage may be used to drive the pixels. The DC voltage may have a voltage range that is approximately half of an AC voltage generally used to power a display using the dot inversion method. As such, the display may use the dot inversion method to provide overall good image quality, yet operate with reduced power consumption.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 8 illustrates a table of driving techniques of the display of FIG. 1, in accordance with an embodiment;

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
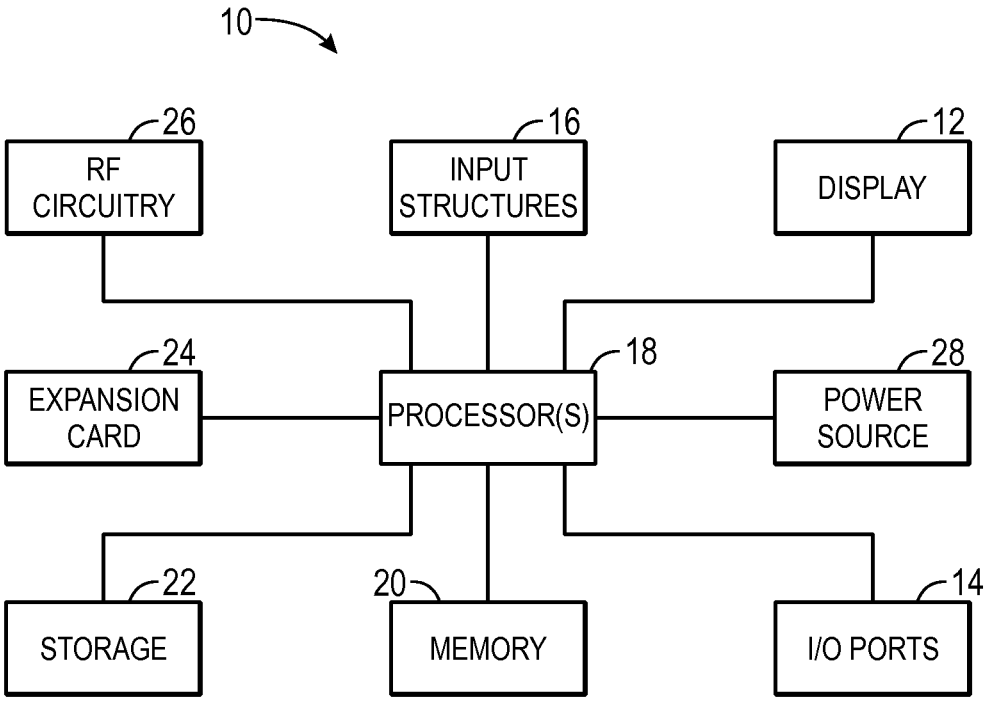
FIG. 1 illustrates a block diagram of an electronic device that may use the techniques disclosed herein, in accordance with aspects of the present disclosure.
Figure 2:
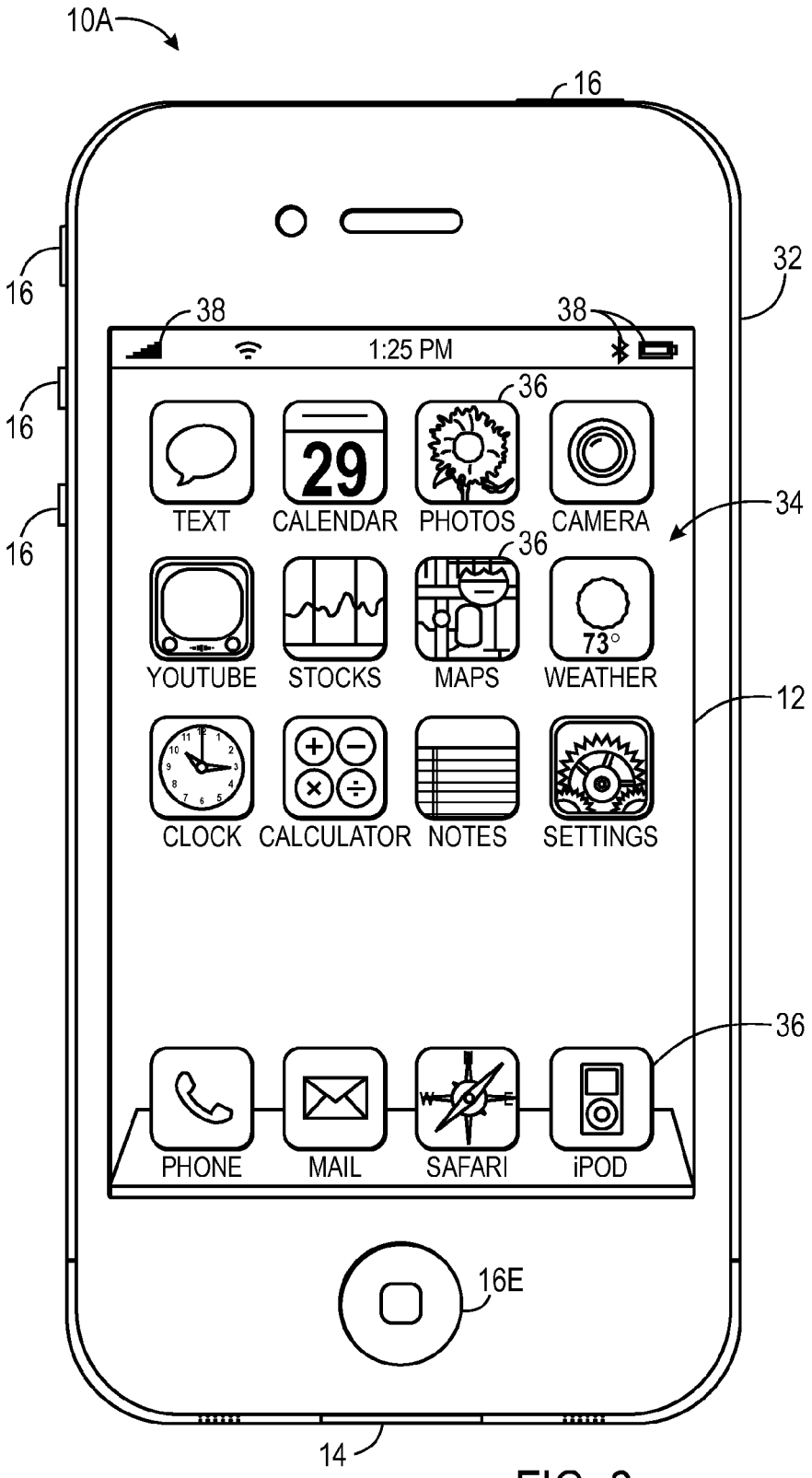
FIG. 2 illustrates a front view of a handheld device, such as an iPhone, representing another embodiment of the electronic device of FIG. 1, in accordance with an embodiment.
Figure 3:
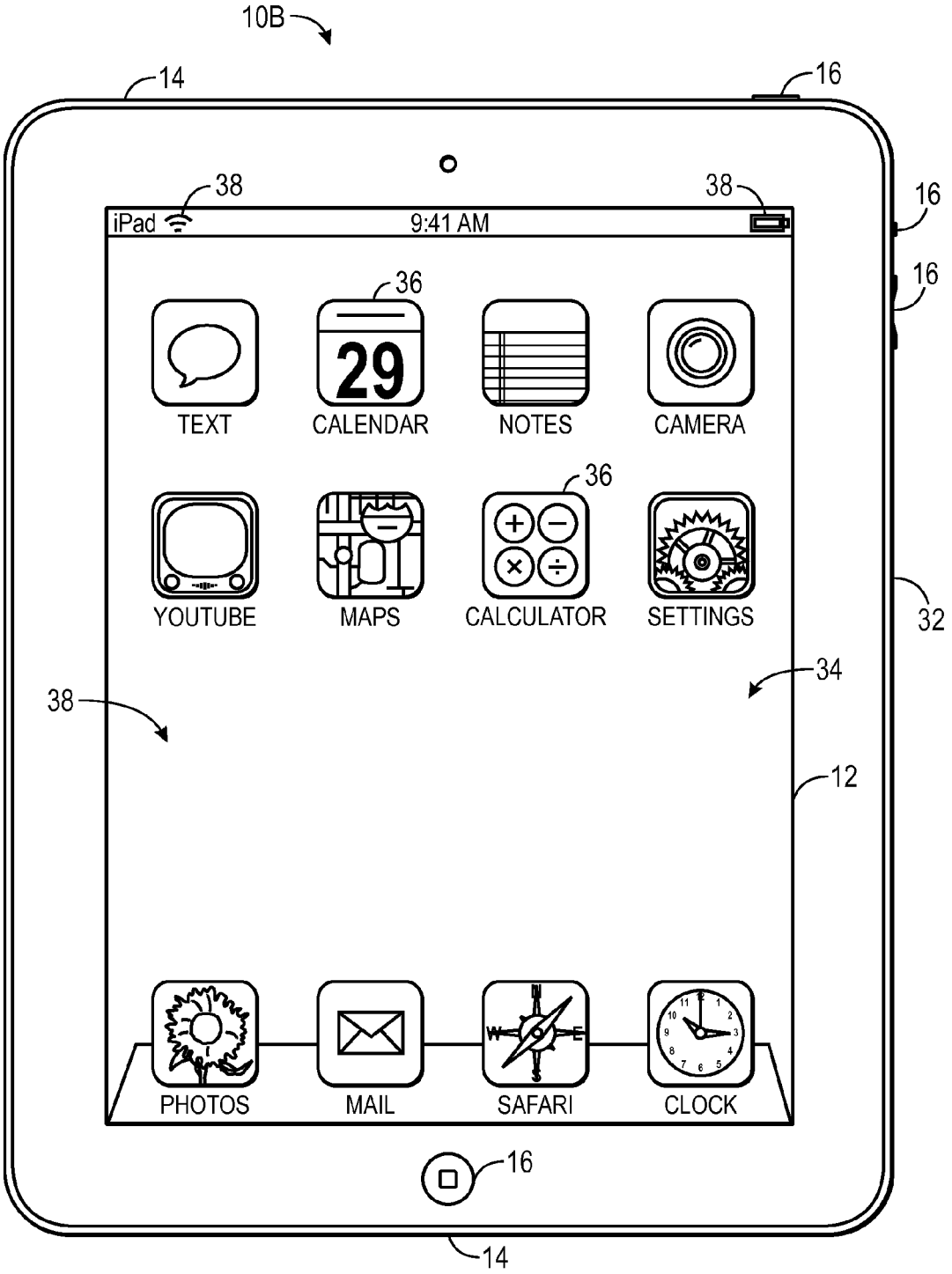
FIG. 3 illustrates a front view of a tablet device, such as an iPad, representing a further embodiment of the electronic device of FIG. 1, in accordance with an embodiment.
Figure 4:
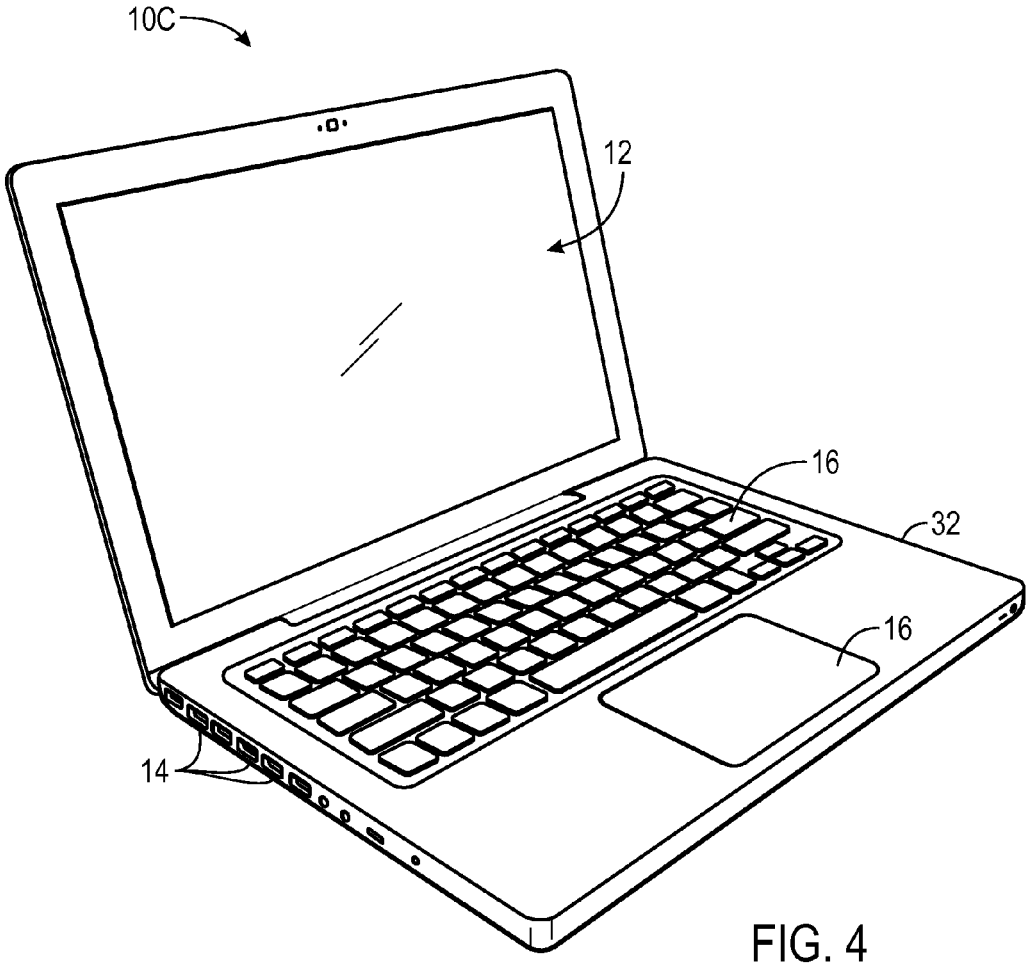
FIG. 4 illustrates a front view of a laptop computer, such as a MacBook, representing an embodiment of the electronic device of FIG. 1, in accordance with an embodiment.

With the foregoing in mind, it is useful to begin with a general description of suitable electronic devices that may employ the display devices and techniques described below. In particular, FIG. 1 is a block diagram depicting various components that may be present in an electronic device suitable for use with such display devices and techniques. FIGS. 2, 3, and 4 respectively illustrate front and perspective views of suitable electronic devices, which may be, as illustrated, a handheld electronic device, a tablet computing device, or a notebook computer.

Turning first to FIG. 1, an electronic device 10 according to an embodiment of the present disclosure may include, among other things, a display 12, input/output (I/O) ports 14, input structures 16, one or more processor(s) 18, memory 20, nonvolatile storage 22, an expansion card 24, RF circuitry 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the handheld device depicted in FIG. 2, the tablet computing device depicted in FIG. 3, the notebook computer depicted in FIG. 4, or similar devices, such as desktop computers, televisions, and so forth. It should be noted that the processor(s) 18 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 18 and/or other data processing circuitry may be operably coupled with the memory 20 and the nonvolatile storage 22 to execute instructions. Such programs or instructions executed by the processor(s) 18 may be stored in any suitable article of manufacture that includes one or more tangible, computer-readable media at least collectively storing the instructions or routines, such as the memory 20 and the nonvolatile storage 22. The memory 20 and the nonvolatile storage 22 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 18.

The display 12 may be a touch-screen liquid crystal display (LCD), for example, which may enable users to interact with a user interface of the electronic device 10. In some embodiments, the electronic display 12 may be a MultiTouch™ display that can detect multiple touches at once.

The input structures 16 of the electronic device 10 may enable a user to interact with the electronic device 10 (e.g., pressing a button to increase or decrease a volume level). The I/O ports 14 may enable electronic device 10 to interface with various other electronic devices, as may the expansion card 24 and/or the RF circuitry 26. The expansion card 24 and/or the RF circuitry 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

As mentioned above, the electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). FIG. 2 depicts a front view of a handheld device 10A, which represents one embodiment of the electronic device 10. The handheld device 10A may represent, for example, a portable phone, a media player, a personal data organizer, a handheld game platform, or any combination of such devices. By way of example, the handheld device 10A may be a model of an iPod® or iPhone® available from Apple Inc. of Cupertino, Calif.

The handheld device 10A may include an enclosure 32 to protect interior components from physical damage and to shield them from electromagnetic interference. The enclosure 32 may surround the display 12, which may include a screen 34 for displaying icons 36. The screen 34 may also display indicator icons 38 to indicate, among other things, a cellular signal strength, Bluetooth connection, and/or battery life. The I/O ports 14 may open through the enclosure 32 and may include, for example, a proprietary I/O port from Apple Inc. to connect to external devices.

User input structures 16, in combination with the display 12, may allow a user to control the handheld device 10A. For example, the input structures 16 may activate or deactivate the handheld device 10A, navigate a user interface to a home screen, navigate a user interface to a user-configurable application screen, activate a voice-recognition feature of the handheld device 10A, provide volume control, and toggle between vibrate and ring modes. The electronic device 10 may also be a tablet device 10B, as illustrated in FIG. 3. For example, the tablet device 10B may be a model of an iPad® available from Apple Inc.

In certain embodiments, the electronic device 10 may take the form of a computer, such as a model of a MacBook®, MacBook® Pro, MacBook Air®, iMac®, Mac® mini, or Mac Pro® available from Apple Inc. By way of example, the electronic device 10, taking the form of a notebook computer 10C, is illustrated in FIG. 4 in accordance with one embodiment of the present disclosure. The depicted computer 10C may include a housing 32, a display 12, I/O ports 14, and input structures 16. In one embodiment, the input structures 16 (such as a keyboard and/or touchpad) may be used to interact with the computer 10C, such as to start, control, or operate a GUI or applications running on computer 10C. For example, a keyboard and/or touchpad may allow a user to navigate a user interface or application interface displayed on the display 12.

Figure 5:
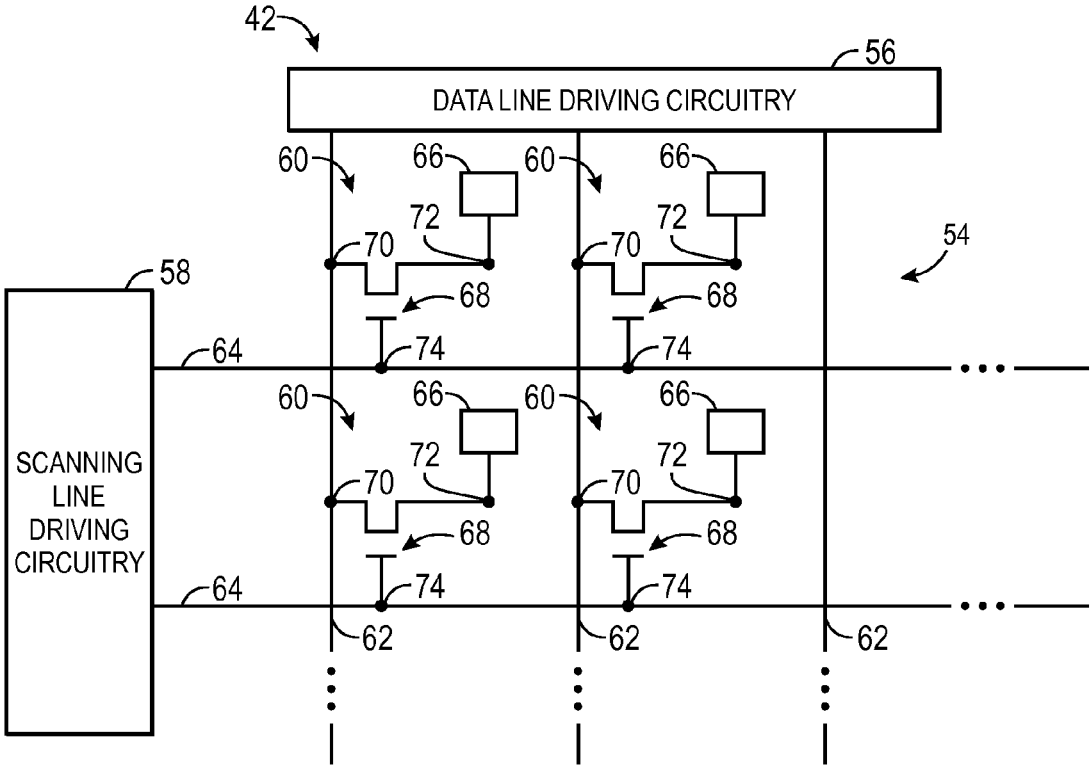
FIG. 5 illustrates circuitry that may be found in the display of FIG. 1, in accordance with an embodiment.

An electronic device 10, such as the devices 10A, 10B, and 10C discussed above, may be configured to operate the display 12 using a dot inversion method with low power consumption to display high quality images. FIG. 5 illustrates pixel-driving circuitry that may be found in the display 12 and may be configured for such operation. In certain embodiments, the pixel-driving circuitry depicted in FIG. 5 may be embodied on a liquid crystal display (LCD) panel 42 of the display 12. The pixel-driving circuitry includes an array or matrix 54 of unit pixels 60 that are driven by data (or source) line driving circuitry 56 and scanning (or gate) line driving circuitry 58. The matrix 54 of unit pixels 60 may form an image display region of the display 12. In such a matrix, each unit pixel 60 may be defined by the intersection of data lines 62 and scanning lines 64, which may also be referred to as source lines 62 and gate (or video scan) lines 64. The data line driving circuitry 56 may include one or more driver integrated circuits (also referred to as column drivers) for driving the data lines 62. The scanning line driving circuitry 58 may also include one or more driver integrated circuits (also referred to as row drivers).

Each unit pixel 60 includes a pixel electrode 66 and a thin film transistor (TFT) 68 for switching access to the pixel electrode 66. In the depicted embodiment, a source 70 of each TFT 68 is electrically connected to a data line 62 extending from respective data line driving circuitry 56, and a drain 72 is electrically connected to the pixel electrode 66. Similarly, in the depicted embodiment, a gate 74 of each TFT 68 is electrically connected to a scanning line 64 extending from respective scanning line driving circuitry 58.

In one embodiment, column drivers of the data line driving circuitry 56 send image signals to the pixels via the respective data lines 62. Such image signals may be applied by line-sequence, i.e., the data lines 62 may be sequentially activated during operation. The scanning lines 64 may apply scanning signals from the scanning line driving circuitry 58 to the gate 74 of each TFT 68. Such scanning signals may be applied by line-sequence with a predetermined timing or in a pulsed manner. Moreover, in certain embodiments, the scanning signals may be applied in an alternating manner in which every other line has scanning signals applied during a first sequence through the rows and the remaining lines have scanning signals applied during a second sequence through rows.

Each TFT 68 serves as a switching element which may be activated and deactivated (i.e., turned on and off) for a predetermined period based on the respective presence or absence of a scanning signal at its gate 74. When activated, a TFT 68 may store the image signals received via a respective data line 62 as a charge in the pixel electrode 66 with a predetermined timing.

The image signals stored at the pixel electrode 66 may be used to generate an electrical field between the respective pixel electrode 66 and a common electrode (VCOM) 76. Such an electrical field may align liquid crystals within a liquid crystal layer to modulate light transmission through the LCD panel 42. Unit pixels 60 may operate in conjunction with various color filters, such as red, green, and blue filters. In such embodiments, a "pixel" of the display may actually include multiple unit pixels, such as a red unit pixel, a green unit pixel, and a blue unit pixel, each of which may be modulated to increase or decrease the amount of light emitted to enable the display to render numerous colors via additive mixing of the colors.

In some embodiments, a storage capacitor may also be provided in parallel to the liquid crystal capacitor formed between the pixel electrode 66 and the common electrode to prevent leakage of the stored image signal at the pixel electrode 66. For example, such a storage capacitor may be provided between the drain 72 of the respective TFT 68 and a separate capacitor line.

Figure 6:
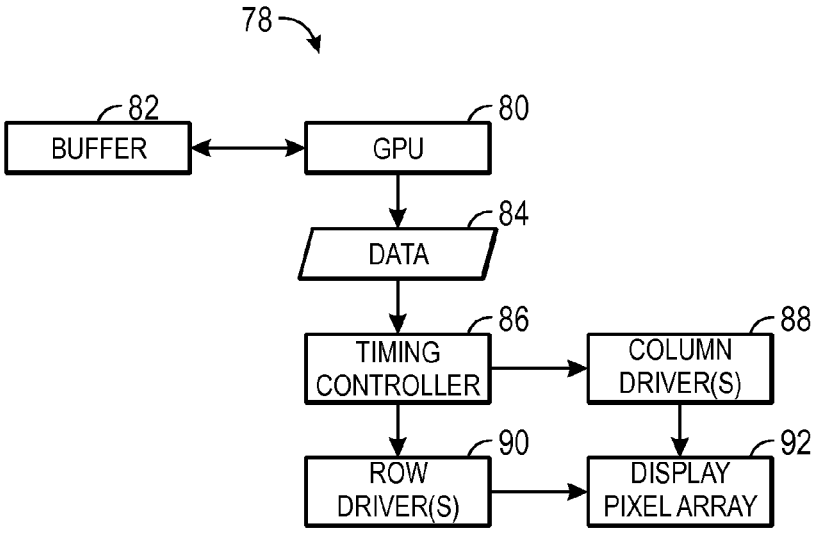
FIG. 6 illustrates a block diagram representative of how the display of FIG. 1 may receive data and drive a pixel array of the display, in accordance with an embodiment.

Certain components for processing image data and rendering images on the display 12 are depicted in block diagram 78 of FIG. 6. In the illustrated embodiment, a graphics processing unit (GPU) 80, or some other processor 18, is coupled to a buffer 82 (e.g., frame buffer). The GPU 80 may use the buffer 82 to temporarily store data 84 before the GPU 80 provides the data 84 to a timing controller (TCON) 86 of the display 12. For example, the GPU 80 may store a frame of data 84 in the buffer 82. The GPU 80 may then sort the frame of data 84 stored in the buffer 82 such that data 84 for driving pixels using a positive polarity is provided to the TCON 86 separately from (e.g., either before or after) data 84 for driving pixels using a negative polarity.

The data 84 generally includes image data that may be processed by circuitry of the display 12 to drive the unit pixels 60 of, and render an image on, the display 12. The TCON 86, may send signals to, and control operation of, one or more column drivers 88 (or other data line driving circuitry 56) and one or more row drivers 90 (or other scanning line driving circuitry 58). These column drivers 88 and row drivers 90 may generate signals for driving the various unit pixels 60 of a pixel array 92 of the display 12 to generate images on the display 12.

Figure 7:
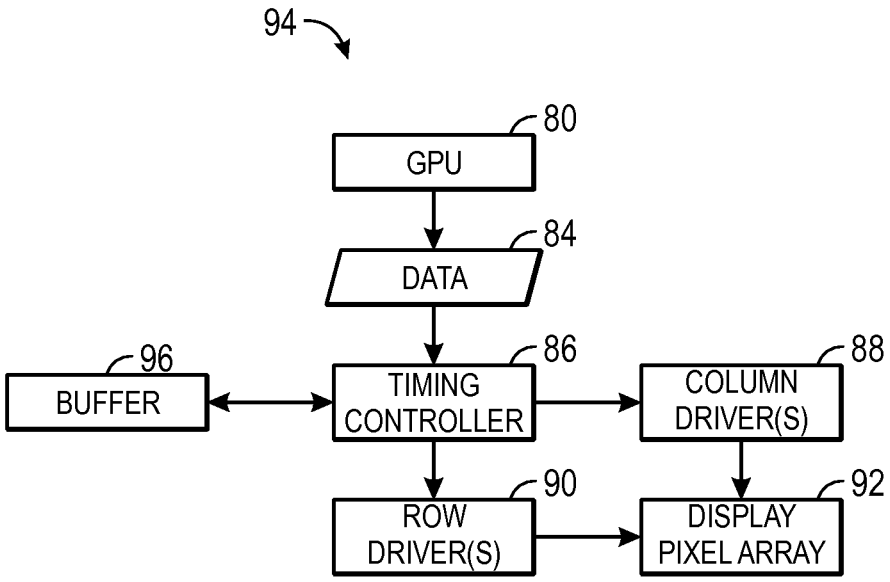
FIG. 7 illustrates another block diagram representative of how the display of FIG. 1 may receive data and drive a pixel array of the display, in accordance with an embodiment.

As illustrated by a block diagram 94 of FIG. 7, in certain embodiments the TCON 86 is coupled to a buffer 96 (e.g., frame buffer). In such embodiments, the TCON 86 may receive data 84 from the GPU 80. The data 84 may include data for driving a frame of pixels. Moreover, the data for driving the frame of pixels may include data for driving pixels using a positive polarity and data for driving pixels using a negative polarity intermingled together. To separate the positive polarity data from the negative polarity data, the TCON 86 may use the buffer 96 to temporarily store the data 84 before the TCON 86 provides the data 84 to the column drivers 88 and/or the row drivers 90. For example, the TCON 86 may store a frame of data 84 in the buffer 96. The TCON 86 may then sort the frame of data 84 stored in the buffer 96 such that data 84 for driving pixels using a positive polarity is provided to the column drivers 88 and/or the row drivers 90 separately from (e.g., before or after) data 84 for driving pixels using a negative polarity.

If the pixel array 92 of the display 12 is driven at a voltage of a particular polarity, electric and chemical changes may occur in the unit pixels 60, thereby lowering the display 12 sensitivity and brightness over time as the driving voltage of the same polarity is applied to the display 12. To overcome this, polarity inversion driving techniques may be utilized. Six such techniques are illustrated in the table of FIG. 8. These techniques include frame inversion, line inversion, column inversion, dot inversion, 1+2 dot inversion, and Z-shape inversion. The frame inversion polarity driving technique is performed by driving, for example, all rows of unit pixels 60 of the display 12 with a positive driving voltage during a first frame 100 and, subsequently, driving all rows of unit pixels 60 of the display 12 with a negative driving voltage during a second subsequent frame 102. This process may be repeated for subsequent frames, where each frame represents the rate at which, for example, the GPU 80 provides an entire set of new data to the display 12. Advantages of this frame inversion technique include relatively low power consumption. However, this technique tends to produce visual artifacts on the display 12 (e.g., a user may perceive differences between the first frame 100 and the second frame 102, such as flicker).

Another driving technique includes the line inversion technique. The line inversion polarity driving technique is performed by driving, for example, odd lines (e.g., rows) of unit pixels 60 of the display 12 with a positive driving voltage and even lines of unit pixels 60 of the display 12 with a negative driving voltage during the first frame 100 and, subsequently, driving odd lines of unit pixels 60 of the display 12 with a negative driving voltage and even lines of unit pixels 60 of the display 12 with a positive driving voltage during the second subsequent frame 102. This process may be repeated for subsequent frames. Advantages of this line inversion technique include relatively low power consumption. However, this technique tends to produce visual artifacts on the display 12 (e.g., a user may perceive differences in the respective lines of unit pixels 60 due to crosstalk and/or power noise).

The column inversion technique is similar to the line inversion technique. Specifically, the column inversion polarity driving technique is performed by driving, for example, odd columns of unit pixels 60 of the display 12 with a positive driving voltage and even columns of unit pixels 60 of the display 12 with a negative driving voltage during the first frame 100 and, subsequently, driving odd columns of unit pixels 60 of the display 12 with a negative driving voltage and even columns of unit pixels 60 of the display 12 with a positive driving voltage during the second subsequent frame 102. This process may be repeated for subsequent frames. Advantages of this column inversion technique include relatively low power consumption. However, this technique tends to produce visual artifacts on the display 12 (e.g., a user may perceive differences in the respective columns of unit pixels 60 due to differences in the magnitudes of the positive and negative driving voltages as vertical line artifacts, vertical crosstalk, and/or vertical line flicker).

To overcome the inherent image quality shortcomings of column inversion, a dot inversion polarity driving technique may be implemented instead. Dot inversion is performed by driving, for example, a unit pixel 60 in the first row and column of the display 12 with a positive driving voltage and driving a unit pixel 60 in the first row and second column of the display 12 with a negative driving voltage during the first frame 100 and, subsequently, reversing the polarity of the driving voltages in the second subsequent frame 102. This process may be repeated for subsequent frames across all of the unit pixels 60 of the display 12. Advantages of this dot inversion technique include reduction of the visual artifacts present using the frame, line, and column inversion polarity driving techniques, however, the dot inversion polarity driving technique may consume a large amount of power.

Additionally, in a 1+2 dot inversion technique the unit pixels 60 may be driven in groups of two such that the unit pixels 60 in the second column and second and third rows of the display 12 may be driven to a positive voltage while the unit pixels 60 in the third column and second and third rows of the display 12 may be driven to a negative voltage in the first frame 100 and, subsequently each group of two unit pixels 60 described above may be driven by an opposite polarity driving voltage in the second subsequent frame 102. Again, this process may be repeated for subsequent frames across all of the unit pixels 60 of the display 12. Advantages of this dot inversion technique include some reduction of the visual artifacts present using the frame, line, and column inversion polarity driving techniques, however, the 1+2 dot inversion polarity driving technique may consume a large amount of power and may not produce images as good as images using the dot inversion technique.

A sixth polarity driving technique is illustrated in the table 98, Z-shape inversion. Z-shape inversion is performed by driving unit pixels 60 in the display 12 in a manner similar to the column inversion technique described above, while generating a visual polarity map consistent with that of the dot inversion polarity driving technique. By driving the unit pixels 60 in a manner similar to the column inversion technique, relatively low amounts of power may be consumed. However, this technique tends to produce visual artifacts on the display 12 (e.g., a user may perceive differences in the respective unit pixels 60 due to vertical crosstalk and/or horizontal line artifacts).

Figure 9:
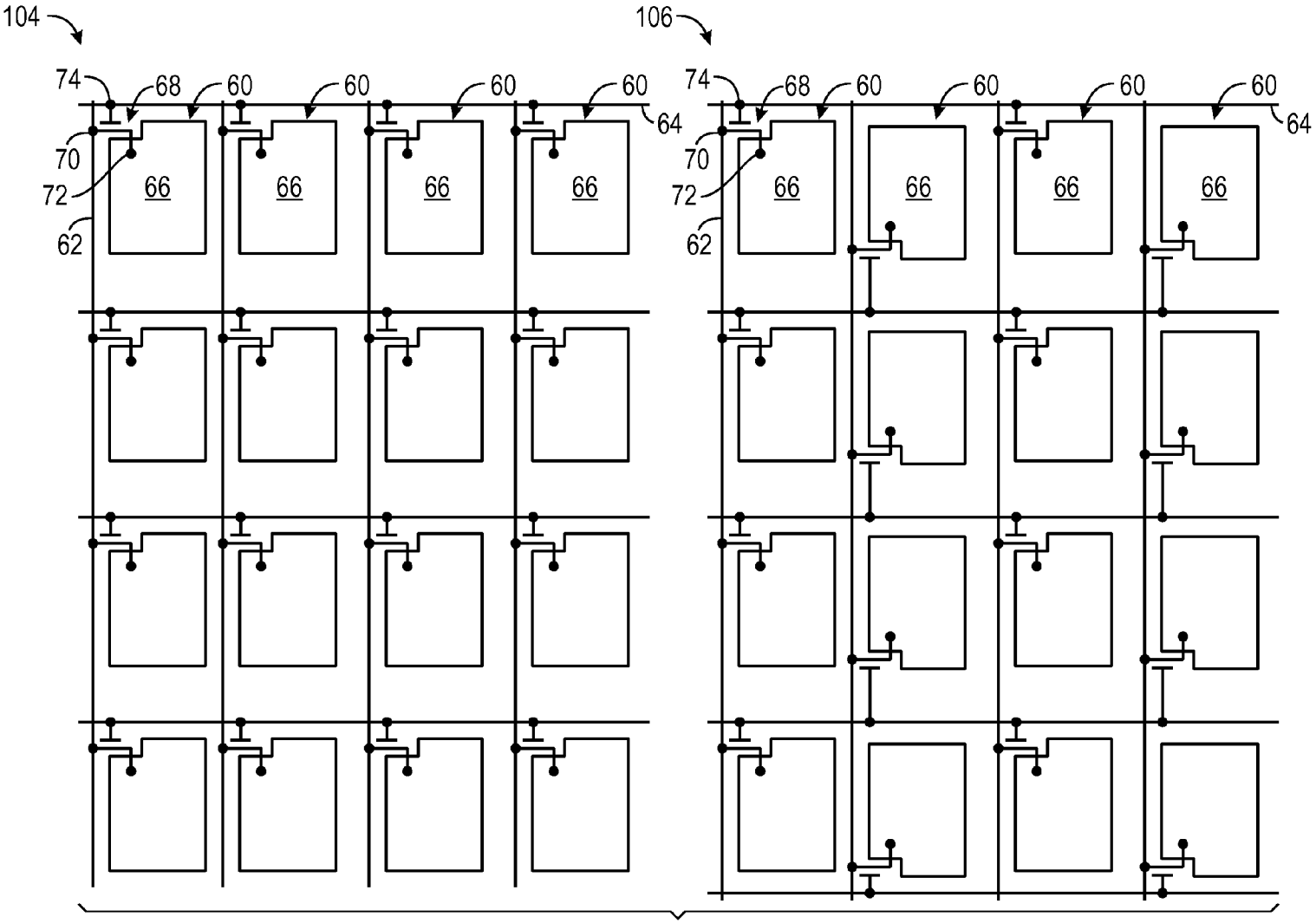
FIG. 9 illustrates a block diagram of arrangements of unit pixels of the display of FIG. 1, in accordance with an embodiment.

As discussed above, image quality of the display 12 may produce the fewest visual artifacts when the dot inversion technique is used. Moreover, the unit pixels 60 of the display may be rearranged to reduce power consumption for implementing the dot inversion technique. Accordingly, FIG. 9 illustrates a block diagram of arrangements of unit pixels 60 of the display 12. Specifically, FIG. 9 illustrates an arrangement 104 of unit pixels 60 of the display 12 for use with one embodiment of a dot inversion polarity driving technique, as well as an arrangement 106 of unit pixels 60 of the display 12 for use with another embodiment of the dot inversion polarity driving technique. As illustrated, each of the unit pixels 60 in the arrangement 104 are coupled to a respective data line 62 in a similar fashion. For example, as illustrated, each of the TFTs 68 of the unit pixels 60 in the arrangement 104 may be coupled to a data line 62 immediately adjacent to the leftmost side of the unit pixels 60. Moreover, each of the unit pixels 60 in the arrangement 104 are coupled to a respective scanning line 64 in a similar fashion. For example, as illustrated, each of the TFTs 68 of the unit pixels 60 in the arrangement 104 may be coupled to a scanning line 64 immediately adjacent to the topmost side of the unit pixels 60.

In contrast to the arrangement 104, in the arrangement 106 the TFTs 68 of the unit pixels 60 may be oppositely coupled to the scanning lines 64 in a row by row manner. For example, the TFTs 68 of the unit pixels 60 in the first row and the first and third columns of the arrangement 106 may be coupled to the scanning line 64 immediately adjacent the uppermost side of the unit pixels 60 in the first row of the arrangement 106, while the TFTs 68 of the unit pixels 60 in the first row and the second and fourth columns of the arrangement 106 may be coupled to the scanning line 64 immediately adjacent the bottommost side of the unit pixels 60 in the first row of the arrangement 106. This configuration may be repeated throughout the arrangement 106 of unit pixels 60 of the display 12.

Specifically, as illustrated in the arrangement 106, the first row of pixels 60 has odd numbered pixels coupled to the topmost scanning line 64. Further, the first row of pixels 60 has even numbered pixels coupled to the second scanning line 64. The second row of pixels 60 has odd numbered pixels also coupled to the second scanning line 64, and the second row of pixels 60 has even numbered pixels coupled to the third scanning line 64. Moreover, the third row of pixels 60 has odd numbered pixels also coupled to the third scanning line 64, and the third row of pixels 60 has even numbered pixels coupled to the fourth scanning line 64. The fourth row of pixels 60 has odd numbered pixels also coupled to the fourth scanning line 64, and the fourth row of pixels 60 has even numbered pixels coupled to the fifth scanning line 64.

As may be appreciated, during one frame the odd numbered pixels of alternating scanning lines and the even numbered pixels of the remaining scanning lines may be driven with a positive polarity, and the even numbered pixels of alternating scanning lines and the odd numbered pixels of the remaining scanning lines may be driven with a negative polarity. Moreover, during a subsequent frame, the odd numbered pixels of alternating scanning lines and the even numbered pixels of the remaining scanning lines may be driven with a negative polarity, and the even numbered pixels of alternating scanning lines and the odd numbered pixels of the remaining scanning lines may be driven with a positive polarity. Accordingly, the polarity of each pixel may change between subsequent frames, thus applying the dot inversion technique.

Figure 10:
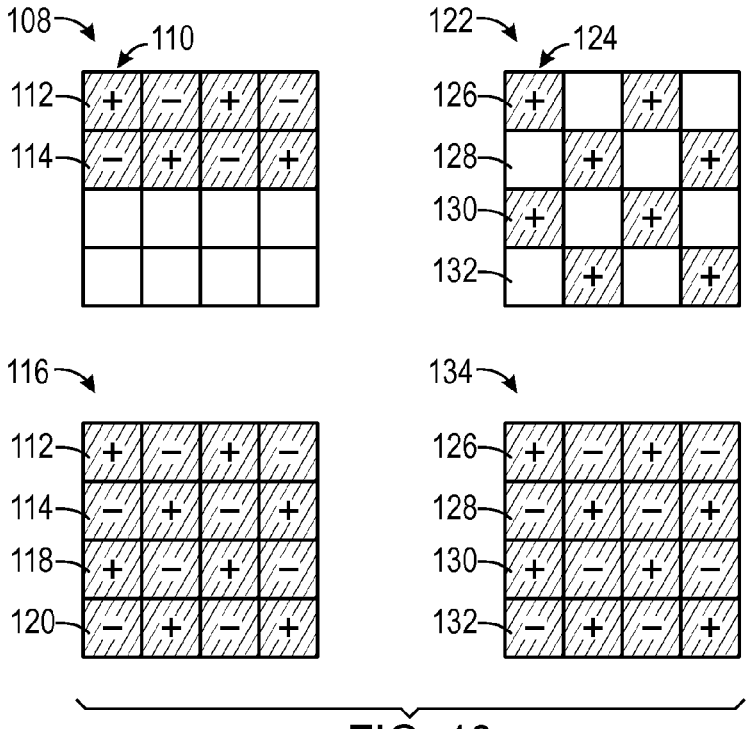
FIG. 10 illustrates a block diagram of methods for driving pixels of the display of FIG. 1, in accordance with an embodiment.

Using the arrangements 104 and/or 106 of the pixels 60, the dot inversion technique may be used to drive the pixels 60. FIG. 10 illustrates a block diagram of methods for driving pixels 60 of the display 12. In one method 108, data may be stored in the pixels 60 using a row-by-row basis. Specifically, during a first time period 110 (e.g., a first half of a frame) data may be stored in rows 112 and 114 in an alternating polarity manner. As may be appreciated, the rows 112 and 114 may be representative of half of the total number of rows in the display 12. Moreover, during a second time period 116 (e.g., a second half of a frame) data may be stored in rows 118 and 120 in an alternating polarity manner. Again, rows 118 and 120 may be representative of half of the total number of rows in the display 12. This method may be repeated in a subsequent frame, but with the polarity of each pixel 60 reversed.

In another method 122, data may be stored in the pixels 60 using an alternating pattern. Specifically, during a first time period 124 (e.g., a first half of a frame) data having a positive polarity may be stored in odd numbered pixels 60 of row 126, even numbered pixels 60 of row 128, odd numbered pixels 60 of row 130, and even numbered pixels 60 of row 132. As may be appreciated, positive polarity pixels 60 illustrated may be representative of half of the total number of pixels 60 in the display 12. Furthermore, the polarity, odd numbering, and/or even numbering may be different in other embodiments. Moreover, during a second time period 134 (e.g., a second half of a frame) data may be stored in even numbered pixels 60 of row 126, odd numbered pixels 60 of row 128, even numbered pixels 60 of row 130, and odd numbered pixels 60 of row 132. The negative polarity pixels 60 illustrated may be representative of half of the total number of pixels 60 in the display 12.

Figure 11:
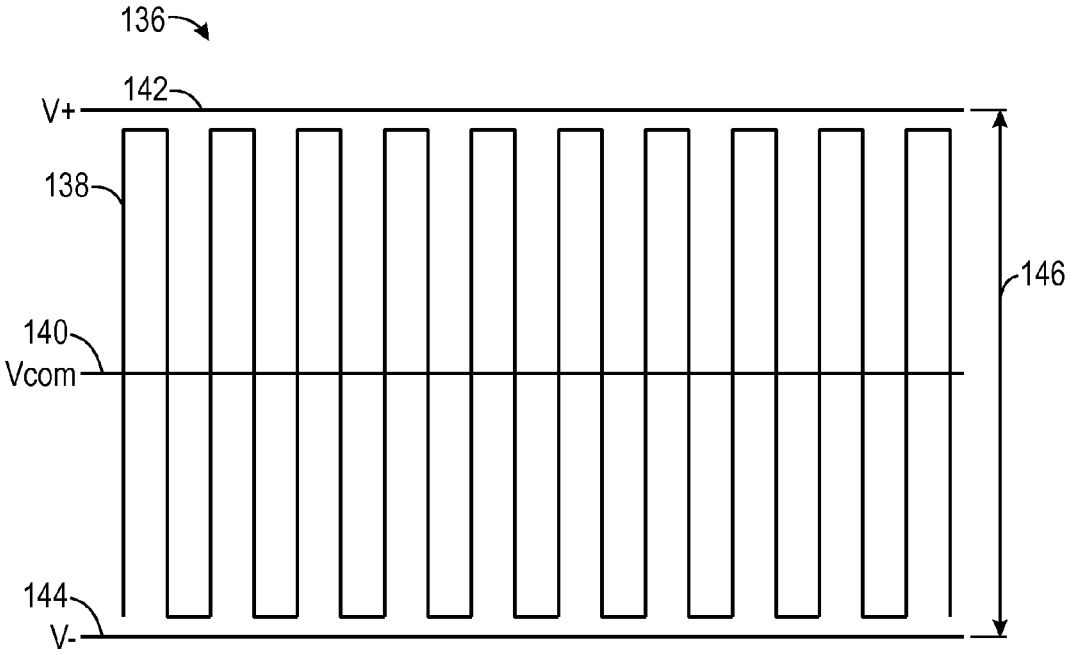
FIG. 11 illustrates a timing diagram of voltages used to drive pixels of the display of FIG. 1, in accordance with an embodiment.

Power consumption for the dot inversion technique may vary between various implementations. FIG. 11 illustrates a timing diagram 136 of one embodiment of voltages used to drive pixels 60 of the display 12. In this embodiment, a voltage signal 138 changes polarity between a positive voltage and a negative voltage relative to a common voltage line (VCOM) voltage 140 (e.g., zero volts, a reference point, etc.). The polarity changes occur for each pixel 60 so that the pixels 60 of the display 12 alternate polarity. Thus, the voltage signal 138 may alternate between a positive voltage near V+142 and a negative voltage near V−144. Accordingly, the voltage signal 138 may operate between a range 146 that extends between V+142 and V−144.

Figure 12:
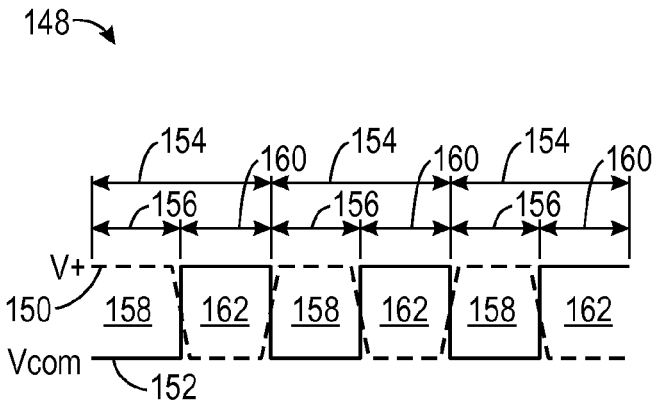
FIG. 12 illustrates another timing diagram of voltages used to drive pixels of the display of FIG. 1, in accordance with an embodiment.

Power consumption for the dot inversion technique may be reduced by operating with a voltage range that is approximately half of the range 146, as illustrated in FIG. 12, thus reducing power consumption by a factor up to approximately four times. Accordingly, FIG. 12 illustrates a timing diagram 148 of voltages used to drive pixels 60 of the display 12. As illustrated, a driving voltage 150 for the pixels 60 may fluctuate between V+ and approximately zero volts (e.g., or another reference voltage, ground, etc.). Moreover, to facilitate a change in polarity, a VCOM voltage 152 changes between zero volts and V+.

A time period 154 represents a time period where a single frame of data is stored in pixels 60 of the display 12. Further, a time period 156 represents a first half of the time period 154. During the time period 156, positive polarity data 158 is provided to half of the pixels 60 of the display 12. Moreover, a time period 160 represents a second half of the time period 154. During the time period 160, negative polarity data 162 is provided to half of the pixels 60 of the display 12. Thus, the polarity of the data provided to the pixels 60 changes within a range that is half of the range 146. Accordingly, power consumption may be drastically reduced (e.g., by up to four times). By reducing the power consumption, smaller components may be used, thereby freeing up space for additional components and/or decreasing the size of the display 12 and/or the electronics device 10.

Figure 13:
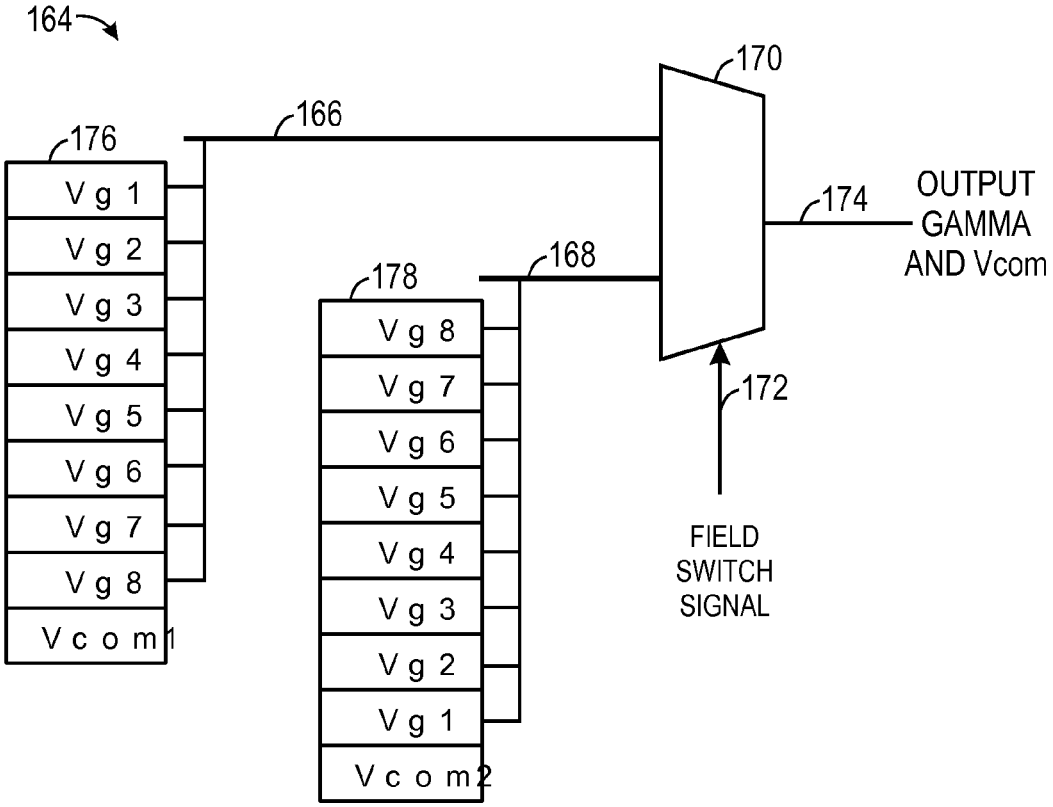
FIG. 13 illustrates a block diagram of switching circuitry used to drive pixels of the display of FIG. 1, in accordance with an embodiment.

Switching circuitry may be used to change pixel data between positive polarity data and negative polarity data. As such, FIG. 13 illustrates a block diagram 164 of switching circuitry used to drive pixels 60 of the display 12. A first input bus 166 for a first voltage polarity and a second input bus 168 for a second voltage polarity may both be provided to a multiplexing device (MUX) 170. Moreover, a field switch signal 172 may be provided to the MUX 170 to switch an output 174 between the first voltage polarity from the first input bus 166 and the second voltage polarity from the second input bus 168. The first input bus 166 may include multiple voltages 176, such as Vg1, Vg2, Vg3, Vg4, Vg5, Vg6, Vg7, Vg8, and Vcom1, as illustrated. As may be appreciated, in some embodiments, Vg1 may correspond to a maximum gamma voltage (e.g., voltage to be stored by a pixel 60) and Vg8 may correspond to a minimum gamma voltage. In other embodiments, Vg1 may correspond to a minimum gamma voltage and Vg8 may correspond to a maximum gamma voltage. Vcom1 may correspond to either a low voltage (e.g., zero volts, a reference voltage, etc.), or a maximum voltage (e.g., V+).

The second input bus 168 may also include multiple voltages 178, such as Vg8, Vg7, Vg6, Vg5, Vg4, Vg3, Vg2, Vg1, and Vcom2, as illustrated. In some embodiments, Vg1 may correspond to a maximum gamma voltage and Vg8 may correspond to a minimum gamma voltage. In other embodiments, Vg1 may correspond to a minimum gamma voltage and Vg8 may correspond to a maximum gamma voltage. Vcom2 may correspond to either a low voltage (e.g., zero volts, a reference voltage, etc.), or a maximum voltage (e.g., V+). As may be appreciated, the voltages 178 correspond to voltages having the opposite polarity of the voltages 176. For the following example we will assume that the voltage range of operation is approximately 4.5 volts (e.g., V+=4.5 volts and 0 v is the voltage reference point), that the first input bus corresponds to a positive polarity, and that the second input bus corresponds to a negative polarity. Accordingly, the multiple voltages 176 may be approximately: Vg1=4.0v, Vg 2=3.5v, Vg3=3.0 v, Vg4=2.5 v, Vg5=2.0v, Vg6=.5v, Vg7=1.0v, Vg8=0.5v, and Vcom1=0v. Furthermore, the multiple voltages 178 may be approximately: Vg1=4.0v, Vg2=3.5v, Vg3=3.0v, Vg4=2.5v, Vg5=2.0v, Vg6=1.5v, Vg7=1.0v, Vg8=0.5v, and Vcom1=4.5v. Thus, when the field switch signal 172 is toggled, the output 174 may switch between inputs from the first input bus 166 and the second input bus 168, thereby resulting in an output of either positive polarity or negative polarity.

Figure 14:
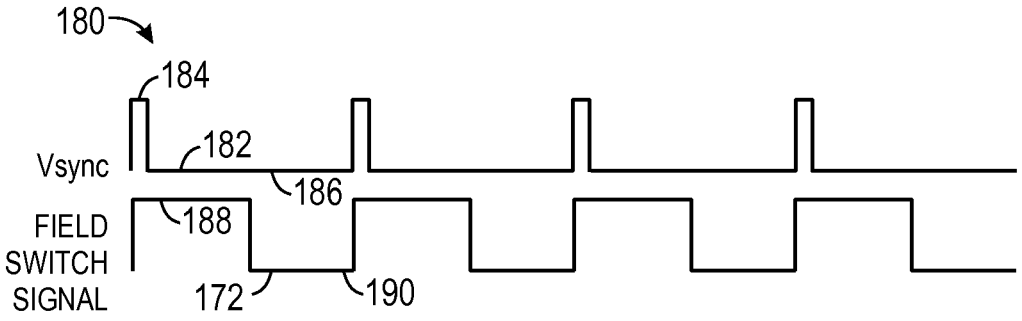
FIG. 14 illustrates a timing diagram of switching signals used to switch driving polarity for driving pixels of the display of FIG. 1, in accordance with an embodiment.

In certain embodiments, the field switch signal 172 should be synchronized with a frame synchronization signal. For example, FIG. 14 illustrates a timing diagram 180 of switching signals used to switch driving polarity for driving pixels 60 of the display 12. A Vsync signal 182 may be received by the display 12 (e.g., via the TCON 86). The Vsync signal 182 may include a positive pulse 184 at the start of each frame, followed by a low value 186 for the remainder of each frame. The positive pulses 184 may facilitate transitioning the field switch signal 172 to a logic high level 188 for half of the frame. The field switch signal 172 may then transition to a logic low level 190 for the remainder of the frame until another positive pulse 184 is received. Accordingly, the display 12 may provide a switching signal to the MUX 170 for changing between positive and negative polarities.

Figure 15:
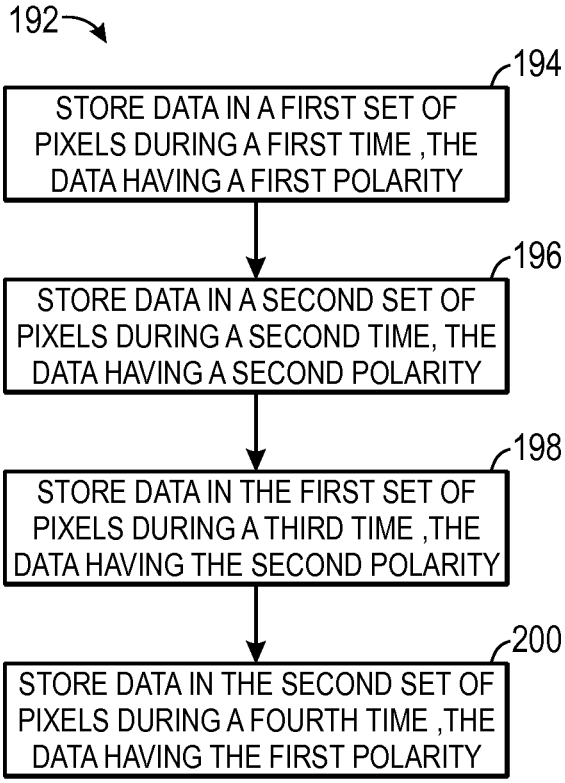
FIG. 15 illustrates a flow chart of a method for driving pixels of the display of FIG. 1, in accordance with an embodiment.

By applying the techniques described herein, power consumed by the display 12 can be significantly reduced. Moreover, the amount of space consumed by components may be decreased due to the power reduction. The techniques described herein may be implemented in various ways. FIG. 15 illustrates a flow chart 192 of one embodiment of a method for driving pixels 60 of the display 12. The display 12 may store data having a first voltage polarity (e.g., positive or negative) in a first set of pixels 60 during a first time period (block 194). In certain embodiments, the first set of pixels 60 may include odd numbered pixels of a row of pixels, even numbered pixels of a row of pixels, half of the pixels, pixels that are not part of a second set of pixels, separate pixels from a second set of pixels, a portion of the pixels, a portion of pixels from each row of pixels in an array of pixels, alternating pixels from each row of pixels in an array of pixels, and/or odd numbered pixels from each of a first set of rows of pixels and even numbered pixels from each of a second set of rows of pixels in which each of the first set of rows of pixels alternate with each of the second set of rows of pixels. As may be appreciated, storing data in the first set of pixels may include activating alternating rows of gate lines.

Either before or after storing the data having the first voltage polarity in the first set of pixels 60, the display 12 may store data having a second voltage polarity (e.g., opposite the first polarity) in a second set of pixels 60 during a second time period (block 196). The first and second time periods are consecutive, and the sum of the first and second time periods is approximately equal to a length of time that it takes to store data in all of the pixels 60 of the display 12 (e.g., a frame). In certain embodiments, the second set of pixels 60 may include odd numbered pixels of a row of pixels, even numbered pixels of a row of pixels, half of the pixels, pixels that are not part of the first set of pixels, separate pixels from the first set of pixels, a portion of the pixels, a portion of pixels from each row of pixels in an array of pixels, alternating pixels from each row of pixels in an array of pixels, and/or odd numbered pixels from each of a first set of rows of pixels and even numbered pixels from each of a second set of rows of pixels in which each of the first set of rows of pixels alternate with each of the second set of rows of pixels. As may be appreciated, storing data in the second set of pixels may include activating alternating rows of gate lines.

The display 12 may store data having the second voltage polarity in the first set of pixels 60 during a third time period (block 198). Either before or after storing the data having the second voltage polarity in the first set of pixels 60, the display 12 may store data having the first voltage polarity in the second set of pixels 60 during a fourth time period (block 200). During subsequent frames, blocks 194-200 may be repeated. Accordingly, the display 12 may operate with low power consumption and may produce images with minimal visual artifacts.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method comprising:

storing data in a first set of pixels of an array of pixels using a first voltage polarity during a first time period, wherein the first set of pixels comprises odd numbered pixels of a first row of pixels;

storing data in a second set of pixels of the array of pixels using a second voltage polarity during a first time period, wherein the second set of pixels comprises even numbered pixels of the first row of pixels, the second set of pixels is separate from the first set of pixels, and the second voltage polarity is opposite the first voltage polarity;

storing data in a third set of pixels of the array of pixels using the first voltage polarity during a second time period, wherein the third set of pixels comprises odd numbered pixels of a second row of pixels; and storing data in a fourth set of pixels of the array of pixels using the second voltage polarity during the second time period, wherein the second set of pixels comprises even numbered pixels of the second row of pixels, wherein the fourth set of pixels is separate from the third set of pixels;

wherein the first time period and the second time period are consecutive and occur during a single frame.

2. The method of claim 1, wherein the first voltage polarity is a positive voltage and the second voltage polarity is a negative voltage.

3. The method of claim 1, wherein the first voltage polarity is a negative voltage and the second voltage polarity is a positive voltage.

4. The method of claim 1, wherein the first time period occurs before the second time period.

5. The method of claim 1, wherein the second time period occurs before the first time period.

6. The method of claim 1, comprising providing a first common voltage line (VCOM) voltage to store data in the first set of pixels and providing a second VCOM voltage to store data in the second set of pixels.

7. The method of claim 6, wherein storing data in the first set of pixels comprises receiving a first plurality of voltage signals that are greater than the first VCOM voltage and storing data in the second set of pixels comprises receiving a second plurality of voltage signals that are less than the second VCOM voltage.

8. The method of claim 6, wherein storing data in the first set of pixels comprises receiving a first plurality of voltage signals that are less than the first VCOM voltage and storing data in the second set of pixels comprises receiving a second plurality of voltage signals that are greater than the second VCOM voltage.

9. An array of pixels for an electronic display comprising:

a first row of pixels comprising a first set of odd numbered pixels and a first set of even numbered pixels;

a second row of pixels comprising a second set of odd numbered pixels and a second set of even numbered pixels;

a third row of pixels comprising a third set of odd numbered pixels and a third set of even numbered pixels;

a first gate line electrically coupled to and configured to drive the first set of even numbered pixels and the second set of odd numbered pixels; and a second gate line electrically coupled to and configured to drive the second set of even numbered pixels and the third set of odd numbered pixels.

10. The array of pixels of claim 9, comprising a third gate line electrically coupled to and configured to drive the first set of odd numbered pixels.

11. The array of pixels of claim 10, comprising a fourth gate line electrically coupled to and configured to drive the third set of even numbered pixels.

12. The array of pixels of claim 9, wherein the first set of even numbered pixels and the second set of odd numbered pixels are configured to store data having a first polarity, and the second set of even numbered pixels and the third set of odd number pixels are configured to store data having a second polarity opposite the first polarity.

13. The array of pixels of claim 12, wherein the first and second polarities are configured to reverse after each frame of data is stored in the array of pixels.

14. The method of claim 1, comprising:

storing data in a first half of the pixels of the array of pixels during the first time period; and storing data in a second half of the pixels of the array of pixels during the second time period after storing data in the first half of the pixels, wherein the first half of pixels comprises alternating pixels from each row of pixels of the array of pixels, and the second half of pixels comprises pixels that are not part of the first half of pixels.

15. The method of claim 14, wherein storing data in the first half of the pixels of the array of pixels during the first time period comprises storing data having a first polarity in the first half of the pixels, and storing data in the second half of the pixels of the array of pixels during the second time period comprises storing data having a second polarity in the second half of the pixels, the second polarity being opposite the first polarity.

16. The method of claim 15, wherein the data having the first polarity comprises data having corresponding positive voltages, and the data having the second polarity comprises data having corresponding negative voltages.

17. The method of claim 15, wherein the data having the first polarity comprises data having corresponding negative voltages, and the data having the second polarity comprises data having corresponding positive voltages.

18. The method of claim 1, comprising:

storing data in a first portion of pixels of the array of pixels during the first time period, wherein the first portion of pixels comprises odd numbered pixels from each of a first set of rows of pixels and even numbered pixels from each of a second set of rows of pixels, each of the first set of rows of pixels alternating with each of the second set of rows of pixels; and storing data in a second portion of pixels of the array of pixels after storing data in the first portion of pixels during the second time period, wherein the second portion of pixels comprises odd numbered pixels from each of the second set of rows of pixels and even numbered pixels from each of the first set of rows of pixels.

19. The method of claim 18, wherein storing data in the first portion of pixels comprises activating alternating rows of gate lines.

20. The method of claim 18, wherein storing data in the second portion of pixels comprises activating alternating rows of gate lines.

21. The method of claim 18, wherein storing data in the first portion of pixels comprises storing data having a positive polarity and storing data in the second portion of pixels comprises storing data having a negative polarity.

22. An electronic device comprising:

a processor; and an electronic display comprising an array of pixels, wherein the electronic display is configured to:

store data in pixels of a first set of pixels of the array of pixels during a first time period, and to store data in pixels of a second set of pixels of the array of pixels during a second time period, the first time period and the second time period are consecutive and occur during a single frame, the first set of pixels comprising a first portion of pixels from each row of pixels of the array of pixels, and the second set of pixels comprising a second portion of pixels from each row of pixels; and provide a first common voltage line (VCOM) voltage of a first value to the first set of pixels; and provide a second VCOM voltage of a second value to the second set of pixels.

23. The electronic device of claim 22, wherein the processor is configured to provide data to the electronic display for the first set of pixels before providing data to the electronic display for the second set of pixels.

24. The electronic device of claim 22, wherein the processor is configured to provide data to the electronic display for the first set of pixels and for the second set of pixels, and wherein the data for the first set of pixels and for the second set of pixels is intermingled.

25. The electronic device of claim 24, wherein the electronic display is configured to separate the data into data for the first set of pixels and data for the second set of pixels.

* * * * *